United States Patent [19]

Rodondi

[11] 4,148,538

[45] Apr. 10, 1979

[54] ELASTOMERIC ELECTRICAL CONNECTOR

[75] Inventor: Andrew F. Rodondi, Sharpsville, Pa.

[73] Assignee: General Motors Corporation, Detroit, Mich.

[21] Appl. No.: 891,513

[22] Filed: Mar. 30, 1978

[51] Int. Cl.[2] ..... H01R 13/54

[52] U.S. Cl. ..... 339/91 R

[58] Field of Search ..... 339/75 R, 75 M, 75 P, 339/76, 77, 78, 79, 82, 91 R

[56] References Cited

U.S. PATENT DOCUMENTS

| | | | |
|---|---|---|---|
| 2,046,221 | 6/1936 | Thomas | 339/91 R |
| 4,026,624 | 5/1977 | Boag | 339/91 R |

*Primary Examiner*—Joseph H. McGlynn
*Assistant Examiner*—John S. Brown
*Attorney, Agent, or Firm*—Donald F. Scherer

[57] ABSTRACT

The drawings illustrate an electrical connector including elastomeric male and female bodies, each having flanged terminals mounted therein. Each of the bodies is adapted to having a lock member mounted thereon such that, when the bodies are interconnected, the lock members also interconnect to retain the bodies in their assembled condition. Additionally, transverse locking pins, formed on the lock members and extended through both the bodies, obstruct outward movement of the flanges of the terminals, and thus serve to prevent removal of the terminals from the bodies.

3 Claims, 5 Drawing Figures

ELASTOMERIC ELECTRICAL CONNECTOR

This invention relates generally to electrical connectors and, more particularly, to such connectors which include (1) means for restraining separation of the connector bodies against a predetermined pull thereon, and (2) means for preventing removal of the terminals mounted therein.

Heretofore, various arrangements have been advocated for preventing the accidental separation of electrical connectors when stress is applied to the connector bodies or to the wire leads extending therefrom.

A general object of this invention is to provide an improved elastomeric electrical connector which lessen the possibilities of accidental separation of the connector bodies and prevent removal of terminals from the bodies.

Another object of the invention is to provide an improved elastomeric electrical connector including interchangeable locking members mounted on each of the male and female bodies thereof such that the locking members interconnect to restrain accidental separation of the bodies. The locking members also include stop means for preventing withdrawal of interconnected terminals mounted in the bodies.

A further object of the invention is to provide (1) an elastomeric electrical connector including male and female connector bodies, with each body having two rows of longitudinal passages formed therethrough, an annular groove formed in each longitudinal passage at a predetermined intermediate point therealong, and a transverse passage formed through each body between the two rows of passages adjacent the outer edge of each annular groove, and (2) two hard plastic lock members each including a base portion, a lock pin extending transversely from the base portion, and two parallel arms with latch means formed on the ends thereof and extending longitudinally from the base portion. At assembly, the lock pins extend through the respective transverse passages to provide a lock means for preventing removal of the terminals by obstructing movement of the flanges of the terminals therepast, and, by virtue of the distal end of each pin interconnecting with the latch means of the other lock member restraining accidental separation of the connector bodies by predetermined opposing pulls on the bodies or the wire leads.

These and other objects and advantages of the invention will become more apparent when reference is made to the following description and accompanying drawings, wherein.

Figure 1:
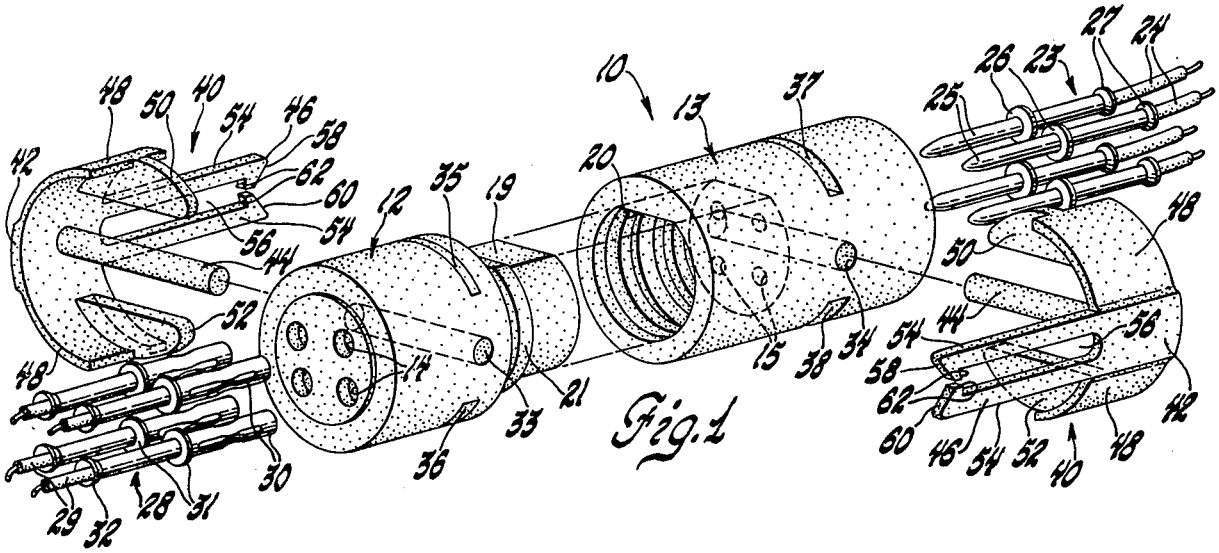
FIG. 1 is an exploded perspective view of an elastomeric connector arrangement embodying the invention.
Figure 2:
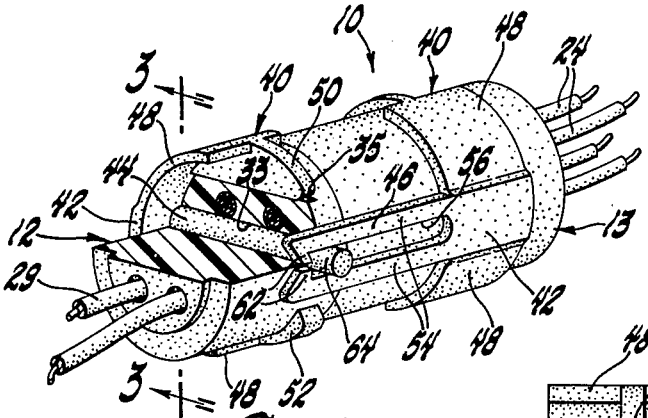
FIG. 2 is a perspective view of the inventive elastomeric connector arrangement in its assembled condition, with a portion thereof cut-away.
Figure 3:
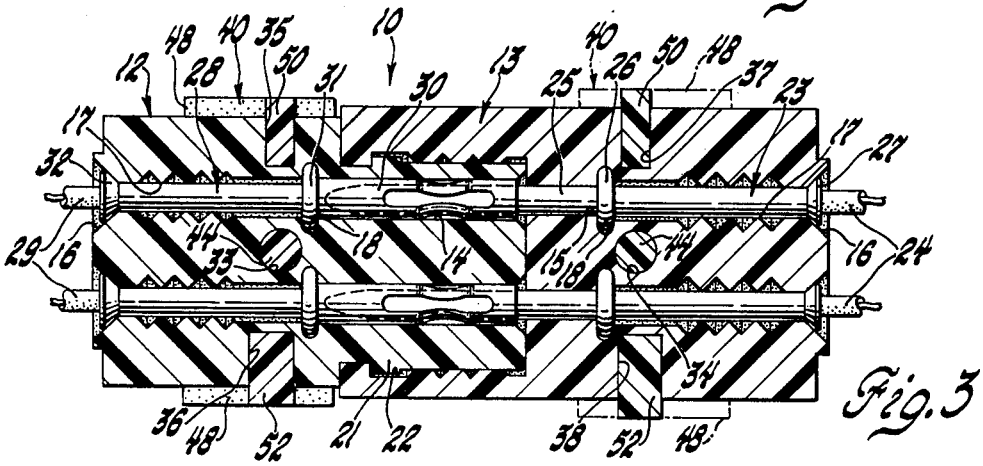
FIG. 3 is a cross-sectional view taken along the plane of the line 3—3 of FIG. 2, and looking in the direction of the arrows.

Referring now to the drawings in greater detail, FIGS. 1 and 2 illustrate and electrical connector 10 including male and female molded elastomeric connector bodies 12 and 13, the body 12 having two parallel rows of longitudinal passages 14 formed therethrough, and the body 13 having two parallel rows of longitudinal passages 15 formed therethrough for axial alignment with the passages 14. As shown in FIG. 3, the passages 14 and 15 each include a chamfered inlet 16, a grooved portion 17, and an annular groove 18.

An outer flat surface 19 and an inner flat surface 20 (FIG. 1) are formed on the respective male and female bodies 12 and 13 to assure a constant circumferential relationship between the interconnected bodies 12 and 13. An annular flange 21 on the male body 12 is longitudinally aligned with an annular groove 22 formed in the female body 13 (FIG. 3).

Male terminals 23 are secured to the ends of wire leads 24. The terminals 23 include pins 25 having a flange 26 formed at an intermediate point therealong, and a flanged inlet end 27. The terminals 23 are pressed through the respective passages 15 until the flanges 26 thereof are fitted into the annular grooves 18 and the flanged inlet end 27 abuts against the chamfered inlet 16. The pins 25 extend a predetermined distance beyond the passages 18.

The terminals 28 are secured to the ends of wire leads 29. The terminals 28 include sleeves 30 having a flange 31 formed at an intermediate point therealong, and a flanged inlet end 32. The terminals 28 are pressed through the respective passages 14 until the flanges 31 and flanged inlet ends 32 cooperate with the annular groove 18 and chamfered inlet 16, in a manner similar to the male terminals 23. The sleeves 30 extend to the ends of the passages 14 for interconnection with the pins 25 of the male terminals 23, once the bodies 12 and 13 are interconnected as shown in FIG. 2.

Transverse passages 33 and 34 are formed through the respective bodies 12 and 13 between the two rows of passages 14 and 15, respectively, at predetermined intermediate points along the respective lengths thereof, the precise locations being adjacent the respective flanges 31 and 26 toward the free end of each body 12 and 13, for a purpose to be described. A first pair of oppositely disposed transverse slots 35 and 36, having different widths and a predetermined depth, are formed in the body 12 in substantially the same transverse plane as the axis of the transverse passage 33. A second pair of oppositely disposed transverse slots 37 and 38, having the same respective dimensions as the slots 35 and 36, are formed in the body 13 in substantially the same transverse plane as the axis of the transverse passage 34.

Figure 5:
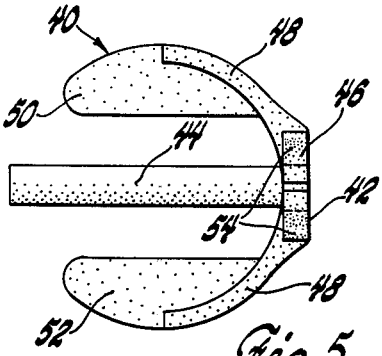
FIG. 5 is an end view taken along the plane of the line 5—5 of FIG. 4, and looking in the direction of the arrows.
Figure 4:
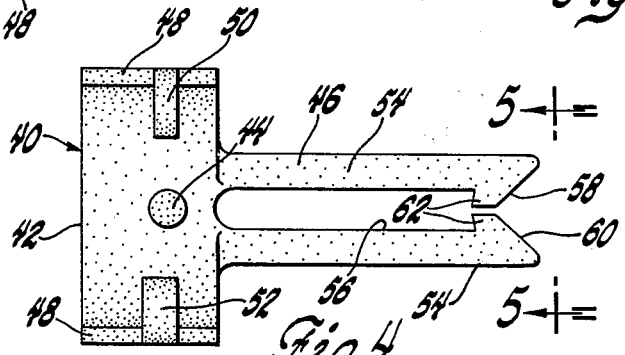
FIG. 4 is a side elevational view of a component of the connector assembly.

FIGS. 4 and 5 illustrate a hard plastic lock member 40 including a base portion 42 and a lock pin 44 of a predetermined diameter and length extending transversely from the one side surface of the base portion for insertion through and a predetermined distance beyond the end of either the transverse passage 33 or the transverse passage 34. A latch member 46 extends longitudinally from one end of the base portion. A pair of sleeve segments 48 are formed on the upper and lower edges of the base portion 42 extending as oppositely dispoed arcuate segments from the same side of the base portion as the lock pin 44. A first chordal segment 50 of a predetermined width is formed to extend inwardly and transversely from one of the sleeve segments 48, and a second chordal segment 52 of a second predetermined width (FIG. 4) is formed to extend inwardly and transversely from the other of the sleeve segments 48. The respective widths of the chordal segments 50 and 52 are such that they are adapted for slip-fit cooperation with either the respective transverse slots 35 and 36 or the respective transverse slots 37 and 38, as indicated in FIGS. 1-3.

The latch member 46 is formed to include parallel arms 54 having a space 56 therebetween whose width is substantially equal to the diameter of the lock pin 44. End surfaces 58 and 60 are formed on the distal ends of the two arms 54 to converge in the direction of the base portion 42, forming a V-shape on the distal ends. Tabs 62 are formed on the adjoining edges of the parallel arms 54 adjacent the end surfaces 58 and 60, the outer surfaces thereof conforming to the slopes of the end surfaces 58 and 60, and the inner surfaces thereof tapering in the same general directions as the respective surfaces 58 and 60.

Referring once again to FIGS. 1 and 2, at assembly, two lock members 40 are mounted on the respective separated bodies 12 and 13, the extensions 50 and 52 fitting into the slots 35, 37 and 36, 38, respectively, and the lock pins 44 extending through the respective transverse passages 33 and 34. The male and female bodies 12 and 13 are then joined, with the flat surfaces 19 and 20 aligned, connecting in the process the aligned male and female terminals 23 and 28 of the wire leads 24 and 29. As the bodies 12 and 13 are forced together, the converging end surfaces 58 and 60 of each lock member 40 serve as guide surfaces for engaging the extended end portion or lock nib 64 (FIG. 2) of the lock pin 44 of the respective other lock member 40, whereupon the surfaces 58 and 60, and, hence, the parallel arms 54, spread until the tabs 62 extend just past the lock nibs 64 and snap back to their original positions with the lock nibs 64 now fitted into the space 56, to be retained therein by the adjacent edge of the tabs 62 and the arms 54 (FIG. 2).

It may be noted in FIG. 3 that, in the above described assembled condition, the interaction of the lock pins 44 and the arms 54 of the lock members 40 serves the dual function of (1) restraining the bodies 12 and 13 in their assembled condition against predetermined opposing pulls thereon, and (2) retaining the terminals 23 and 28 in their assembled condition by virtue of each lock pin 44 being positioned between and adjacent the respective parallel rows of passages 14 and 15 to thus provide an intermediate flexible locking shoulder with respect to the adjacent edge of each groove 18, and thereby serve as a stop memberball for all the flanges 31 or 26.

It should be apparent that more than two longitudinal passages per row could be formed in each body 12 and 13, for receiving additional terminals 28 and 23, and that the latter would be locked in place by the lock pins 44 in the manner described above.

While but one embodiment of the invention has been shown and described, other modifications thereof are possible.

The embodiments of the invention in which an exclusive property or privilege is claimed are defined as follows:

1. In an electrical connector, the combination comprising:

an elastomeric connector body having a generally longitudinal open-ended terminal cavity extending therethrough, and a transverse passage extending therethrough to provide a flexible wall partly defining the longitudinal open-ended terminal cavity, said flexible wall having a locking shoulder for retaining a terminal in the longitudinal cavity, and a hard plastic lock member having a base portion, a lock pin extending transversely from the base portion, and a latch arm extending generally longitudinally from the base portion, said lock pin being disposed in the transverse passage of the connector body to rigidify the flexible wall carrying the locking shoulder to provide a terminal lock, said lock pin protruding outwardly of the transverse passage at an end opposite the base portion to provide a lock nib, and said latch arm projecting longitudinally of the connector body for latching engagement with a lock nib of a matable electrical connector.

2. In an electrical connector, the combination comprising:

an elastomeric connector including aligned male and female bodies having a plurality of open-ended longitudinal passages extending therethrough, and a transverse passage extending through each male and female body at an intermediate point along the length thereof, an annular groove formed in each longitudinal passage adjacent the inner side of each transverse passage providing a flexible locking shoulder therebetween for retaining a terminal in each longitudinal passage, and a pair of hard plastic lock members, each having a base portion, a lock pin extending transversely from the base portion, and a latch arm extending generally longitudinally from the base portion, said lock pins being disposed in the respective transverse passages of the connector bodies to rigidify each flexible locking shoulder to provide a terminal lock, said lock pins protruding outwardly of the transverse passages at the ends opposite the base portions on the opposite sides of the connector bodies to provide oppositely dispoed lock nibs, and said latch arms projecting longitudinally of the respective connector bodies on opposite sides thereof for latching engagement with the respective other lock nib.

3. An elastomeric electrical connector comprising axially aligned and interconnected male and female bodies, two rows of two or more axially aligned longitudinal passages formed through said bodies, a transverse passage formed at an intermediate point along the length of each of said bodies, an annular groove formed in each of said longitudinal passages in each of said bodies adjacent the inner side of each transverse passage providing a flexible locking shoulder between each annular groove and adjacent transverse passage, interconnected male and female terminals mounted in each longitudinal passage, a flange formed on each male and female terminal and mounted in each annular groove, a pair of hard plastic lock members, each including a base portion and a lock pin extending tranversely from the base portion and through each transverse passage, the two lock pins extending in opposite directions and providing a lock nib beyond each transverse passage, a pair of latch arms extending longitudinally from each of said base portions along oppositely disposed sides of the respective male and female bodies toward the other lock pin so as to engage said extended lock nib thereof to thereby restrain said bodies in their assembled condition against predetermined opposing pulls thereon, and said lock pins retaining said terminals in their assembled condition by serving as stop members for all the flanges of the respective two rows of terminals adjacent the respective flexible locking shoulders.

* * * * *